US006563272B1

(12) United States Patent
Dufort

(10) Patent No.: US 6,563,272 B1
(45) Date of Patent: May 13, 2003

(54) COMBINED SCAN/SUSTAIN DRIVER FOR PLASMA DISPLAY PANEL USING DYNAMIC GATE DRIVERS IN SOI TECHNOLOGY

(75) Inventor: Benoit Dufort, Valhalla, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/126,238

(22) Filed: Apr. 22, 2002

(51) Int. Cl.[7] ..... G09G 3/28

(52) U.S. Cl. ..... 315/169.3; 315/169.4; 345/60; 345/68

(58) Field of Search ..... 315/169.3, 169.4; 345/60, 68

(56) References Cited

U.S. PATENT DOCUMENTS

| | | | | |
|---|---|---|---|---|
| 4,866,349 A | 9/1989 | Weber et al. | ..... | 315/169.4 |
| 5,081,400 A | 1/1992 | Weber et al. | ..... | 315/169.4 |
| 5,793,158 A | 8/1998 | Wedding, Sr. | ..... | 313/493 |
| 5,900,694 A | 5/1999 | Matsuzaki et al. | ..... | 313/484 |
| 5,994,929 A | 11/1999 | Sano et al. | ..... | 327/111 |
| 6,072,447 A | 6/2000 | Noborio | ..... | 345/60 |
| 6,150,767 A | 11/2000 | Huang | ..... | 315/169.4 |

OTHER PUBLICATIONS

Weber, Larry F. "The Promise of Plasma Displays for HDTV." SID '00; pp. 16–20.

Wedding, Donald K. "Overview of PDP Intellectual Property" Texas Chapter of SID '01 Digest.

*Primary Examiner*—David Vu

(57) ABSTRACT

A scan/sustain driver for a plasma display panel. The driver integrates the scanning and sustain functions on one chip without external components for level shifting. The driver can perform both the scanning and sustaining of individual lines. External components are used for energy recovery. Control logic signals received from images can be internal or external.

15 Claims, 20 Drawing Sheets

COMBINED SCAN/SUSTAIN DRIVER FOR PLASMA DISPLAY PANEL USING DYNAMIC GATE DRIVERS IN SOI TECHNOLOGY

BACKGROUND OF THE INVENTION

1. Field of the Invention

The present invention relates to a driver in silicon on insulator (SOI) technology for a plasma display panel (PDP).

2. Discussion of the Related Art

Flat Panel Displays (FPDs) are thin, flat electronic devices used for displaying alphanumeric information, graphics, and images. FPDs have increased in performance and capability dramatically over the past decade, so that the most advanced FPDs now are capable of displaying full-color, high definition images at full video rates. A number of different technologies are used for making FPDs. These technical approaches have different characteristics, with differing strengths and weaknesses. The dominant flat panel display technology is the active matrix liquid crystal display (AMLCD).

PDPs incorporate the same "twisted nematic" effect and color filters used in AMLCDs. The only difference is that instead of having a transistor associated with each pixel, the PALC display uses plasma discharges to control the liquid crystal. Despite an inherently lower cost to manufacture, plasma display panels (PDPs) have relatively high power consumption, high operating voltage, and low color brightness in comparison to LCDs. If these deficiencies can be addressed successfully, plasma technology has the potential for a larger market share. Computer displays, primarily for portable personal computers, are the largest single commercial market. Undeniably, today's laptop computers were primarily enabled by the flat panel display. In addition to the computer market, there are a broad range of other commercial applications particularly in applications requiring large-area including vehicle displays (aviation cockpits, automobile dashboards and navigation displays), personal digital assistants, video telephones, medical systems, and high definition and high resolution, full motion video (including HDTV). Much of the demand today for plasma displays is in the business and commercial, industrial equipment, and military markets. They compete with Electroluminescent Displays (ELDs) for use in ticketing machines and financial terminals and with vacuum florescent displays (VFDs) for process control equipment and medical instruments.

PDP applications in commercial and military information technology enable a vast new range of flat panel displays (FPDs)—Millimeters deep, weighing well under a pound, rugged enough for avionics, and completely portable panels are currently being developed. The advantages of PDPs over AMLCDs include: brighter picture, wider viewing angle, better color purity, and higher contrast ratio.

The largest FPDs available are plasma display panels. Plasma Display Panels are large, flat and thin displays on which a picture is created between two glass plates. The front plate contains horizontal pairs of electrodes called sustain and scan electrodes. In each of the one million pixels light is generated by a small ionized gas (usually noble) discharge between the plates. Depending upon the type of gas used, various colors can be generated. In a monochrome display the light from the gas discharge is that which is seen on the display. However, to obtain a multicolor display, phosphors are required. The plasma panel uses a gas discharge at each pixel to generate ultraviolet radiation that excites the particular phosphor that is located at each pixel. A certain trigger (or priming) voltage is required to start the ionization process, after which the process will continue at a lower voltage and the brightness of the emission will depend directly upon the current passing through the ionized gas, known as a plasma. The predominant technology is an AC driven display that obtains color by using the ultraviolet emission from a combination of He—Kr—Xe or Ne gases to excite red, green and blue phosphors. Focal points are addressing schemes and picture processing with the goals of lowering the costs and improving the picture quality. Such are particularly useful for producing a large moving picture, which looks like a painting on the wall.

The sustaining and scanning functions are performed separately in panels available today. Integrated circuits exist for scan functions, for example STV7697A, made by STMicroelectronics, but sustain functions are performed with discrete high voltage components or hybrid thin-film circuits. Opto-couplers or gate-driving circuits with external components (capacitors and bootstrap diodes) are required to drive these discrete transistors.

Since PDPs require a high voltage potential and are mostly capacitive, an energy recovery circuit is required. Moreover, the inductor lowers electromagnetic interference (EMI) by making the high-voltage and high-current signal transitions less abrupt. In contrast with LCDs, no inductor is needed because the energy is lower. Energy recovery methods are used to recycle the energy in the panel capacitance. Weber et al. (U.S. Pat. Nos. 4,866,349 and 5,081,400) and Sano et al. (U.S. Pat. No. 5,994,929) topologies are the most common. Weber uses an inductor and a capacitor, two transistors, two diodes, and separate drivers. For properly addressing the panel, extra transistors are needed for each panel rows. Weber sustains the panel through these high-voltage scan transistors. The sustain current flows through each scan device and unused power is dissipated, which further results in a drop in sustain voltage.

The prior art uses discrete components and a special IC to control the gate drivers or circuits on the printed circuit board. A disadvantage of the prior art PDP is the large number of components on the board.

Despite the significant advantages afforded by the PDP, there is still a desire to reduce the number of components, and therefore, reduce the cost.

SUMMARY OF THE INVENTION

Accordingly, the present invention is directed to a combined scan/sustain driver for a plasma display panel using dynamic gate drivers in SOI technology that substantially obviates one or more of the problems due to limitations and disadvantages of the related art.

An advantages of the present invention is to provide a new driver for a plasma display panel that can perform both the scanning and sustaining of individual lines. The integrated circuit is adapted to integrated fabrications and allows scanning as well as sustaining with the same circuit. The circuit allows multiple rows to be scanned individually while being able to sustain multiple rows with the same drivers using a single inductor.

Another advantage of the present invention is that the gate drivers do not require external components to level-shift the control signals. The drivers can be paralleled and used to sustain multiple lines using a single inductor for energy recovery.

The integration of both the scanning and sustaining functions in one chip without external components for level shifting (gate driving) can decrease the cost of fabrication and increase the performance of plasma display panels.

The main characteristics of the PDP scan/sustain driver include: single row design for scan that can be paralleled for sustain with single inductor; control via 5 volts logic; variable driving strength level shifters; and produces less than 5 volts drop during 500 mA output current plasma discharge.

Additional features and advantages of the invention will be set forth in the description that follows, and in part will be apparent from that description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a scan/sustain driver circuit for a plasma display panel, comprises a chip including at least three gate drivers, wherein each gate driver has at least one high selector and at least one low selector for digital logic control; at least four high voltage N-type transistors; at least two high voltage diodes; at least two zener diodes; a low voltage buffer having at least one low selector; and an energy recovery circuit provided external to the chip; wherein at least one of the at least four high voltage N-type transistors is connected to a voltage supply of about 200 volts; and wherein at least one of the at least four high voltage N-type transistors is connected to ground.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, the example of which is shown in the accompanying drawings.

Figure 1A:
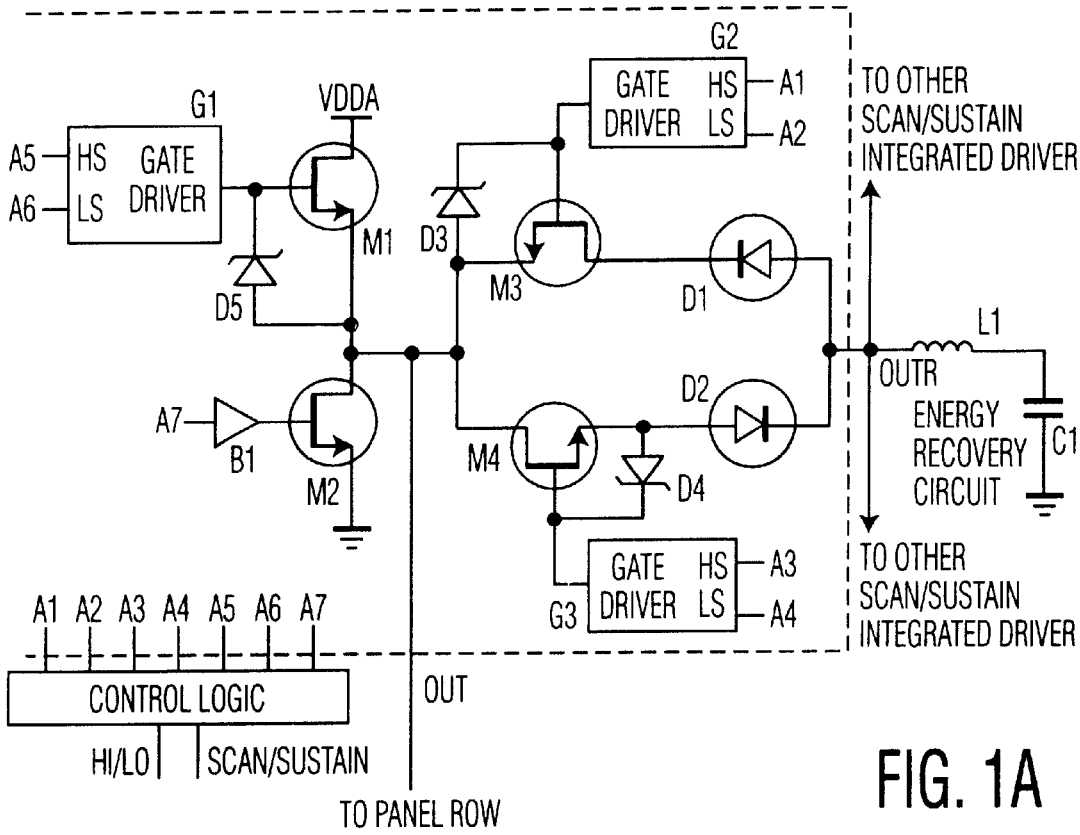
FIG. 1A is a scan/sustain driver schematic with external control logic.

FIG. 1A is a scan/sustain driver schematic with external control logic. The circuit shown in FIG. 1A includes the following components: N-type high voltage transistors M1, M2, M3 and M4, high voltage diodes D1 and D2, protection low voltage Zener diodes D3, D4 and D5, low voltage logic buffer (or digital gate driver) B1, gate drivers G1, G2 and G3, control logic having selectors A1, A2, A3, A4, A5, A6 and A7 that receive logic signals from images, and an energy recovery circuit including terminal OUTR, inductor L1 and capacitor C1. The external logic signals are used to provide different scan and sustain voltages. There is at least one energy recovery circuit for the panel, however, the invention contemplates providing as many circuits as there are rows of lines, and many circuits can be provided on one chip. For example, a 48" panel, having a screen area 480×640 pixels wide, will have approximately 64 circuits per chip and approximately 10 chips.

Figure 1B:
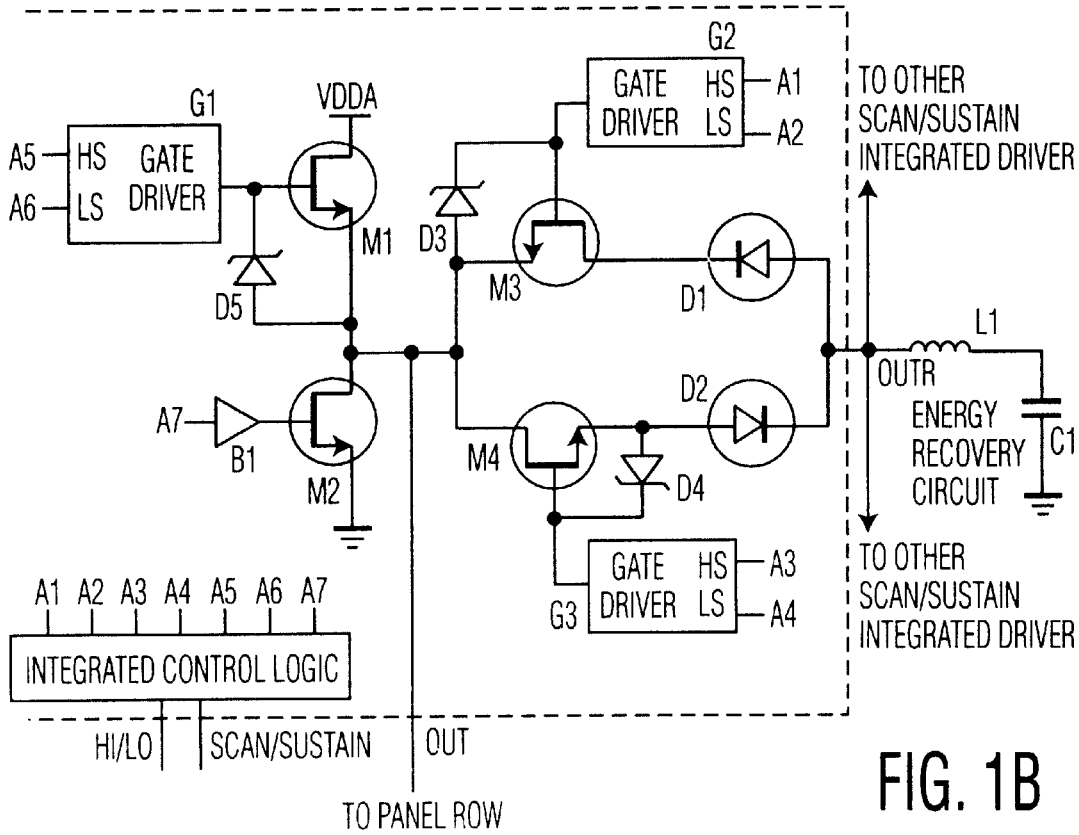
FIG. 1B is a scan/sustain driver schematic with integrated control logic.

FIG. 1B is a scan/sustain driver schematic with integrated control logic. This figure is similar to FIG. 1A, except that the control logic is provided on the chip. An advantage of having the internal control logic on the chip is that the chip can interface with currently available technology.

Figure 1C:
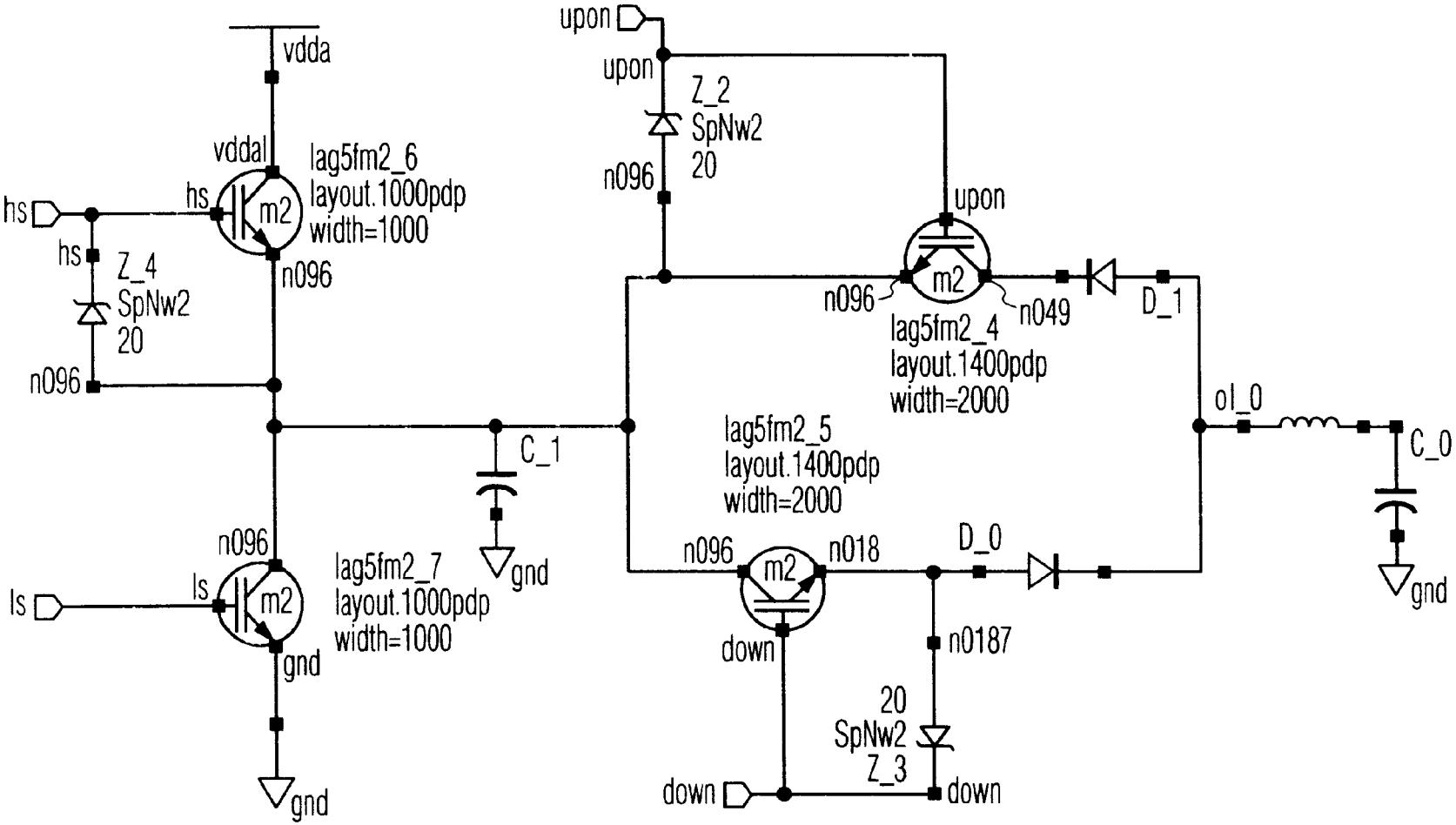
FIG. 1C is a simplified schematic of the scan/sustain driver without the gate drivers and buffer.

FIG. 1C is a simplified schematic of the scan/sustain driver without the gate drivers and buffer.

Figure 2A:
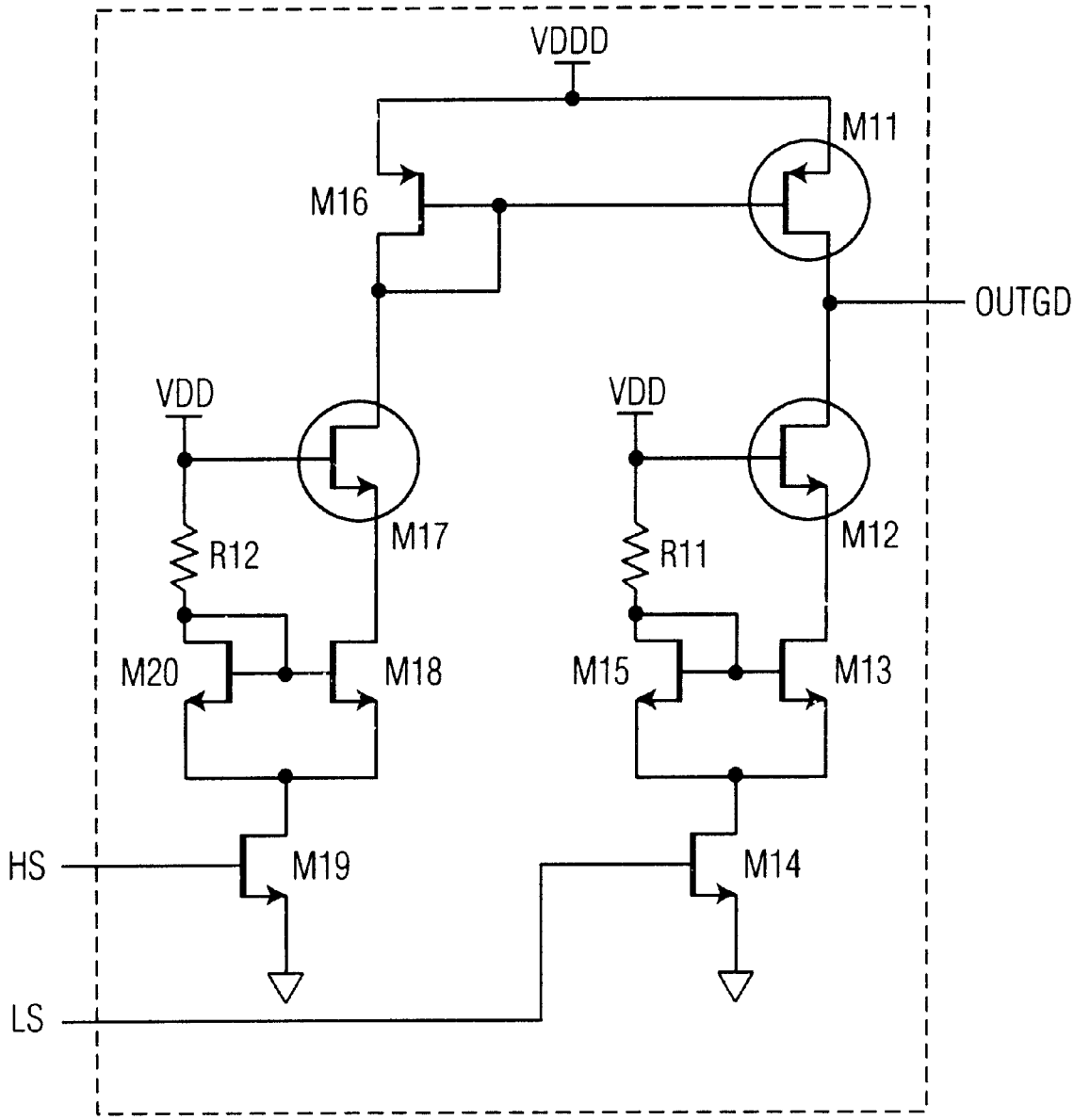
FIG. 2A is a schematic of the gate driver.

The gate driver schematic is shown in FIG. 2A. It includes high voltage N-type transistors M12 and M17, low voltage N-type transistors M13, M14, M15, M18 M19, and M20, low voltage P-type transistor M16, high voltage P-type transistor M11 and integrated resistors R11 and R12. The inductor L1 and capacitor C1 in FIG. 1A and 1B are external components used for energy recovery. They can be shared by multiple integrated driver circuits with their OUTR terminals connected together. In FIGS. 1A and 1B, VDDA has a potential of about 200 V. In FIG. 2A, VDDD has a potential of about 207 V and VDD has a potential of about 12 V.

The operation of the circuit in FIGS. 1A and 1B can be divided into 2 periods, the sustain period where light is emitted from the panel and the scan period where the panel is addressed.

Figure 2B:
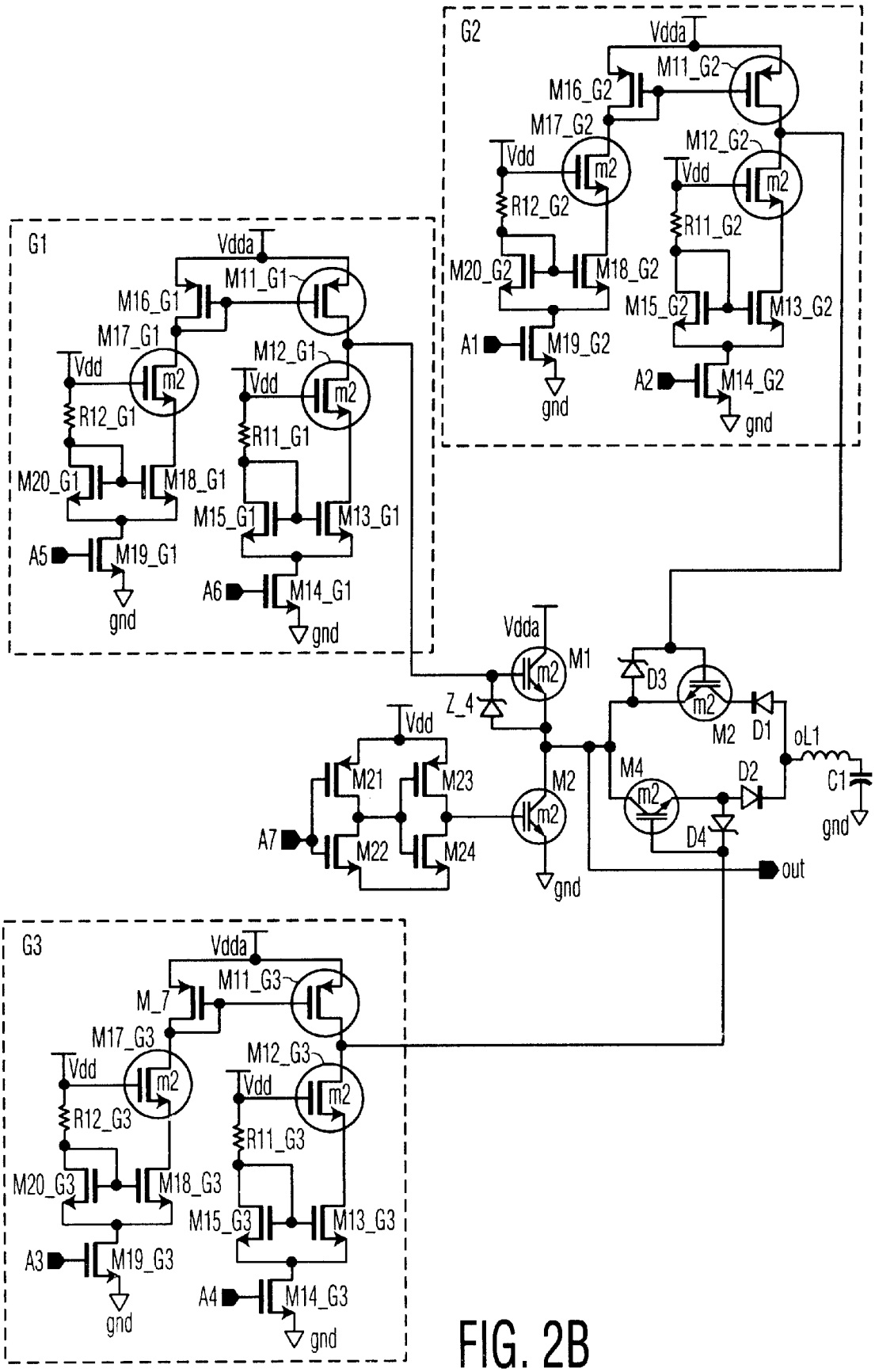
FIG. 2B is a scan/sustain driver and gate driver schematic.

FIG. 2B is a scan/sustain driver and gate driver schematic. This figure incorporates FIG. 1A or 1B and FIG. 2A, however, the control logic is not shown.

Figure 2C:
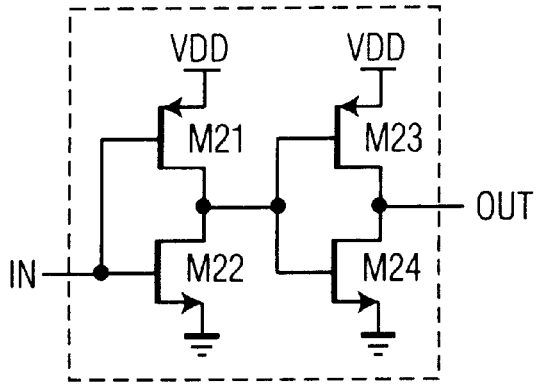
FIG. 2C is a buffer schematic.

FIG. 2C is a buffer schematic for buffer B1. The buffer include low voltage transistors M21, M22, M23 and M24, two voltages VDD, an input IN and an output OUT.

Figure 3:
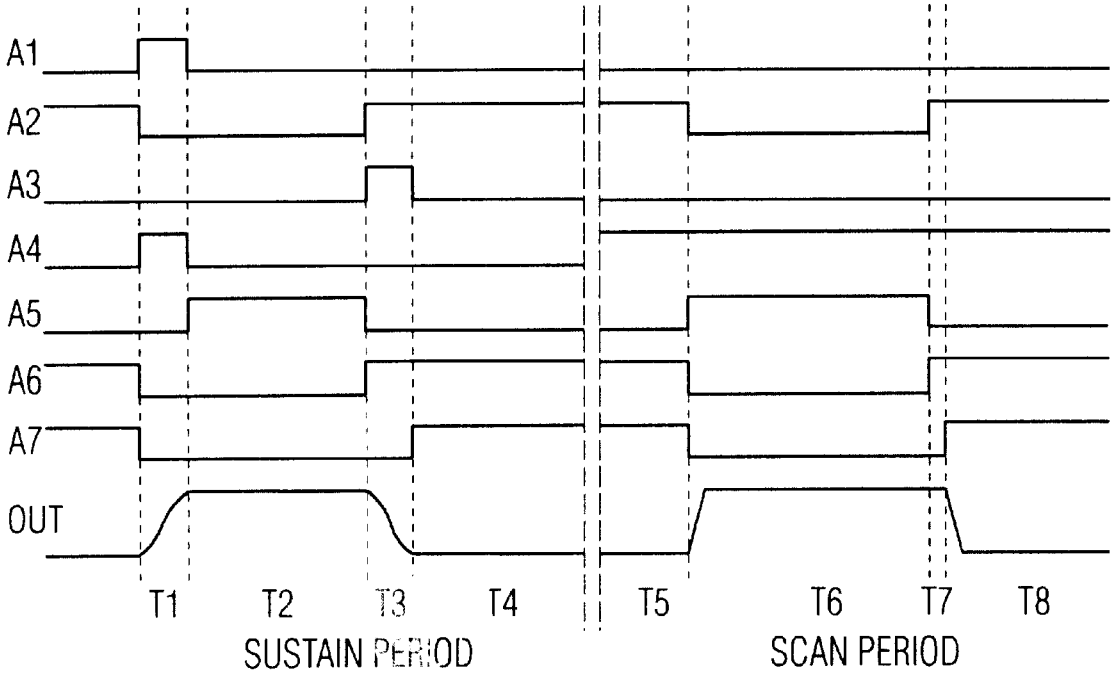
FIG. 3 illustrates a timing diagram for FIGS. 1A and 1B.

FIG. 3 illustrates a timing diagram for FIGS. 1A and 1B. Referring to FIG. 3, during T1, M2 is turned off with the buffer B1, transistor M4 is turned off by gate driver G3 and transistor M3 is turned on by gate driver G2. Gate driver G1 is kept at high impedance. A current will go through inductor L1, diode D1 and transistor M3 to charge the panel capacitance at terminal OUT. The resonant circuit will maintain the current until it reverses direction and is blocked by reversed biased diode D1. Terminal OUT is close to potential VDDA at this point. In T2, gate drivers G2 and G3 are in high impedance mode. Gate driver G1 opens transistor M1 and OUT is maintained at a potential of VDDA. At T3, gate driver GI turns M1 off, gate driver G2 turns M3 off and gate driver G3 turns M4 on. The current goes from the panel capacitance at terminal OUT through M4, diode D2 and inductor L1. The resonant circuits keeps the current flowing until it reverses direction and is blocked by reversed biased diode D2. At this point terminal OUT is close to 0 V. At T4 gate driver G3 is in high impedance and buffer B1 turns M2 on and terminal OUT is maintained at 0 V. The cycle repeats for a number of times, which dictates the brightness of the pixel.

In the scan period, the energy recovery is unused and transistors M3 and M4 are kept off to isolate the energy recovery circuit from transistors M1 and M2 and keep the charge on energy recovery capacitor C1.Gate driver G3 keeps M4 off during all of the scan period. During T5, gate driver G2 keeps M3 off, gate driver G1 keeps M1 off and buffer B1 keeps M2 on. The OUT terminal is at 0 V. During T6, gate driver G2 goes to high impedance mode to avoid dissipation through Zener diode D3. Gate driver G1 turns M1 on and buffer B1 turns M2 off. The voltage at terminal OUT reaches VDDA. During T7, gate driver G1 turns M1 off while gate driver G2 keeps M3 off. At T8, buffer B1 turns M2 on and terminal OUT reaches 0 V. Period T7 allows the gate of M1 to discharge before M2 turns on, eliminating cross-conducting currents through M1 and M2.

The gate driver circuits functions as follows (see FIG. 2A). To bring the OUTGD terminal to 0 V, the LS terminal is raised to 12 V while terminal HS is at 0 V. Current flows through transistor M14. The magnitude of this current is set by resistor R11 and the current mirror circuit formed by transistors M15 and M13. The current flows through high voltage transistor M12 and discharges the capacitance at OUTGD. To bring terminal OUTGD to VDDD. To keep terminal OUTGD at high impedance, terminals HS and LS are both kept at 0 V and no current flows through the circuit. Different resistors can be used in gate drivers G1, G2 and G3 to match the currents to the size of the transistors the gate drivers are controlling. This eliminates unwanted dissipation and allows rise and fall time control.

Figure 4:
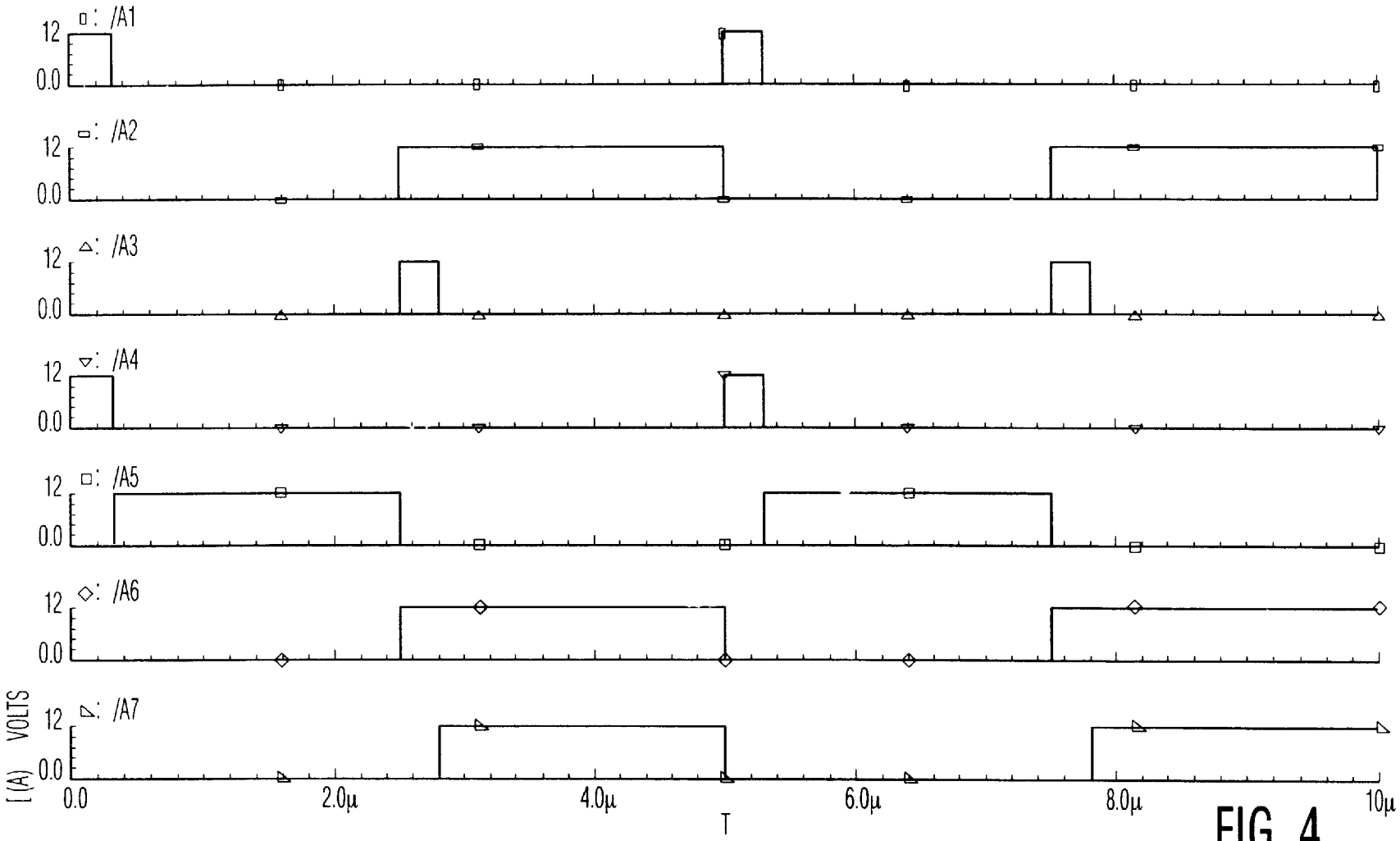
FIG. 4 illustrates a waveform diagram of the gate driver simulation results for sustain period control.

FIG. 4 illustrates a waveform diagram of the gate driver simulation results for sustain period control. The sustain waveforms are the digital signals associated with the address electrodes. The waveforms labeled A1 and A2 are signals supplied to the gate driver G2 shown in FIGS. 1A and 1B. These address pulsers generate the special waveforms needed for the address drivers to apply the proper signals to the address electrodes. The A3 and A4 waveform are signals supplied to the gate driver G1 shown in FIGS. 1A and 1B. The A5 and A6 waveform are signals supplied to the gate driver G3 shown in FIGS. 1A and 1B. The A7 waveform are signals supplied to buffer B1. Control logic can be added to generate signals A1 to A7 from two signals, a high/low signal, which produces a high voltage or low voltage output, and a scan/sustain signal depending on the desired period. The vertical axis shows that the voltage ranges from about 0 volts to about 12 volts. The horizontal axis shows a time period between about 0 $\mu$s and about 10 $\mu$s.

Figure 5:
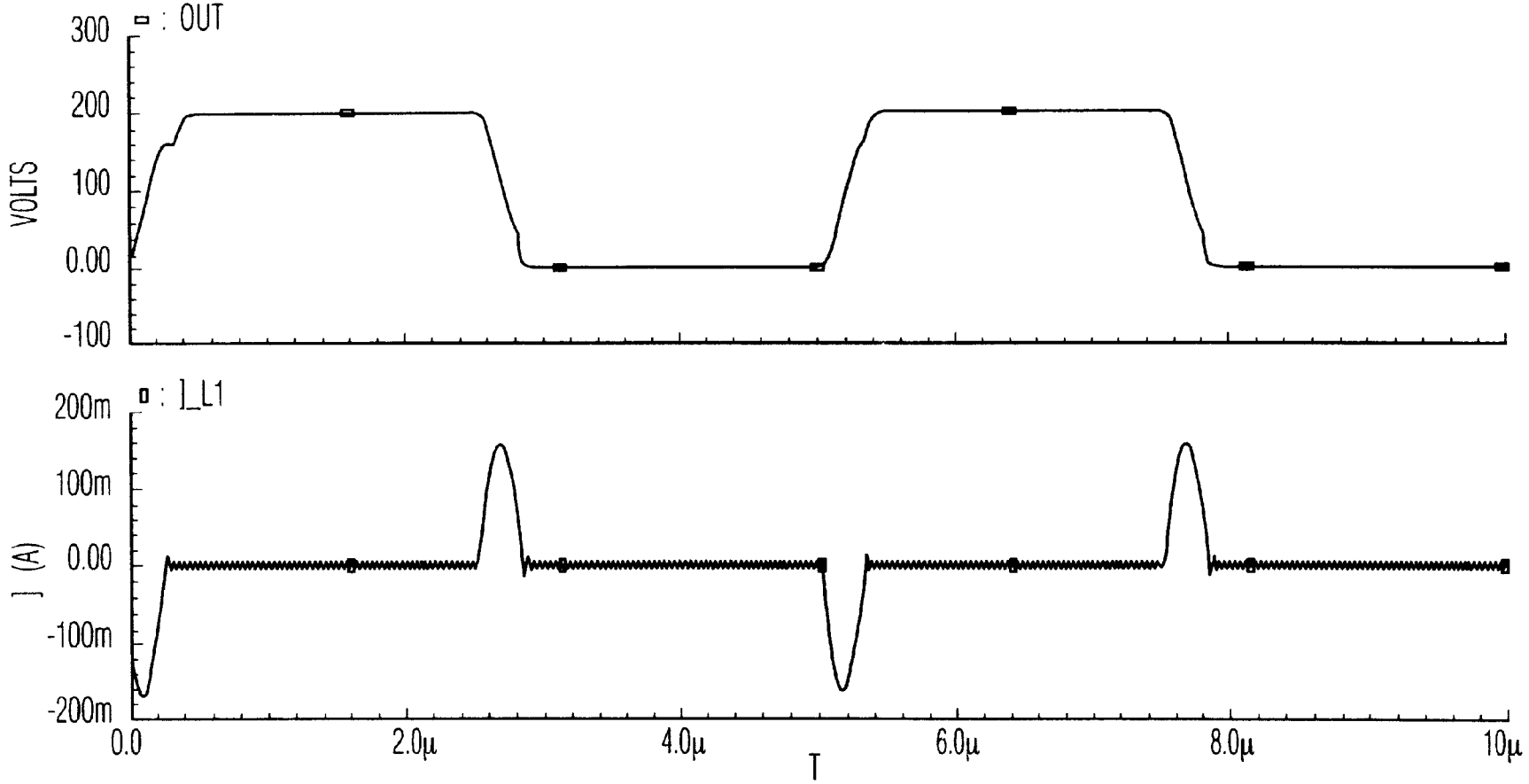
FIG. 5 illustrates a waveform diagram of the gate driver simulation results for sustain output.

FIG. 5 illustrates a waveform of the gate driver simulation results for sustain output. Current through the inductor L1 in the energy recovery circuit of FIGS. 1A and 1B frequently grows and decays at a very fast rate so that large amounts of electrical noise is generated. This noise tends to create problems for other circuits in the system and can easily mis-trigger many of the logic gates that are used to control the operations of the plasma display panel. Another problem associated with the large current is the large energy dissipation that occurs in the transistor to discharge the capacitance. It makes the transistors hot and requires special heat sinking. This energy dissipation can be enough to burn out the transistors in some cases. In addition, the energy lost in heating these transistors cannot be recovered and it increases the power requirements of the power supply and the power consumption of the plasma display system. All of these problems can be reduced by using slightly delayed sustain voltages for different rows of the panel, thereby reducing the instantaneous power and current.

Since an inductor L1 is placed in series with the panel, then the capacitor C1 can be charged and discharged through the inductor. Ideally, this would result in zero power dissipation since the inductor would accumulate all of the energy otherwise lost in the capacitance of the panel and transfer it to and from the capacitor C1. However, switching devices are needed to control the flow of energy to and from L1, as C1 is charged and discharged. The "ON" resistance, output capacitance, and switching transition time are characteristics of these switching devices that can result in significant energy loss. The amount of energy that is actually lost due to these characteristics, and hence the efficiency, is determined largely by how well the circuit is designed to minimize these losses.

In addition to charging and discharging C1, the sustainer must also supply the large gas discharge current for the plasma panel. This current is proportional to the number of pixels that are "ON". There are two ways to minimize this dissipation. One is to minimize the output resistance of the sustainer by using very low resistance output drivers, and the other is to minimize the number of pixels that are "ON" at any time.

The vertical axis on the top waveform shows that the voltage ranges from about 0 volts to about 200 volts. The sustain output in the simulation was approximately 170 volts. The vertical axis on the bottom waveform shows that the current ranges from about −200 mA to about 200 mA. The sustain output in the simulation was approximately 150 mA. The horizontal axis shows that a time period between about 0 $\mu$s and about 10 $\mu$s in both waveforms. Scan and sustain functions on the driver of the present invention may have the same voltage even though both functions are not performed at the same time for an entire line. However, VDDA can be different for the scan and the sustain functions.

Figure 6:
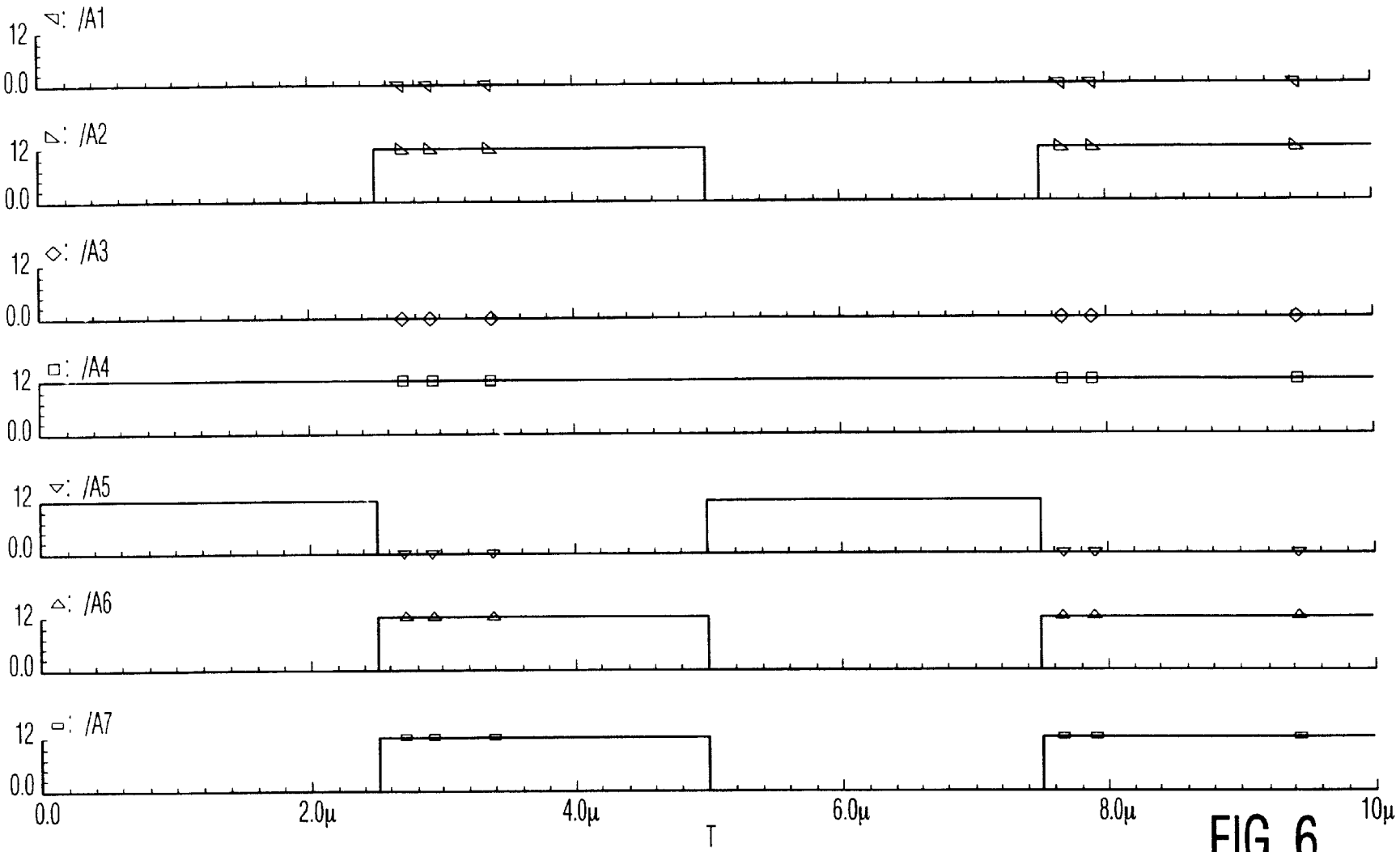
FIG. 6 illustrates a waveform diagram of the gate driver simulation results for scan period control.

FIG. 6 illustrates a waveform diagram of the gate driver simulation results for scan period control. The waveforms labeled A2, A5, A6, A7 were substantially identical to the waveforms in the sustain period control.

Figure 7:
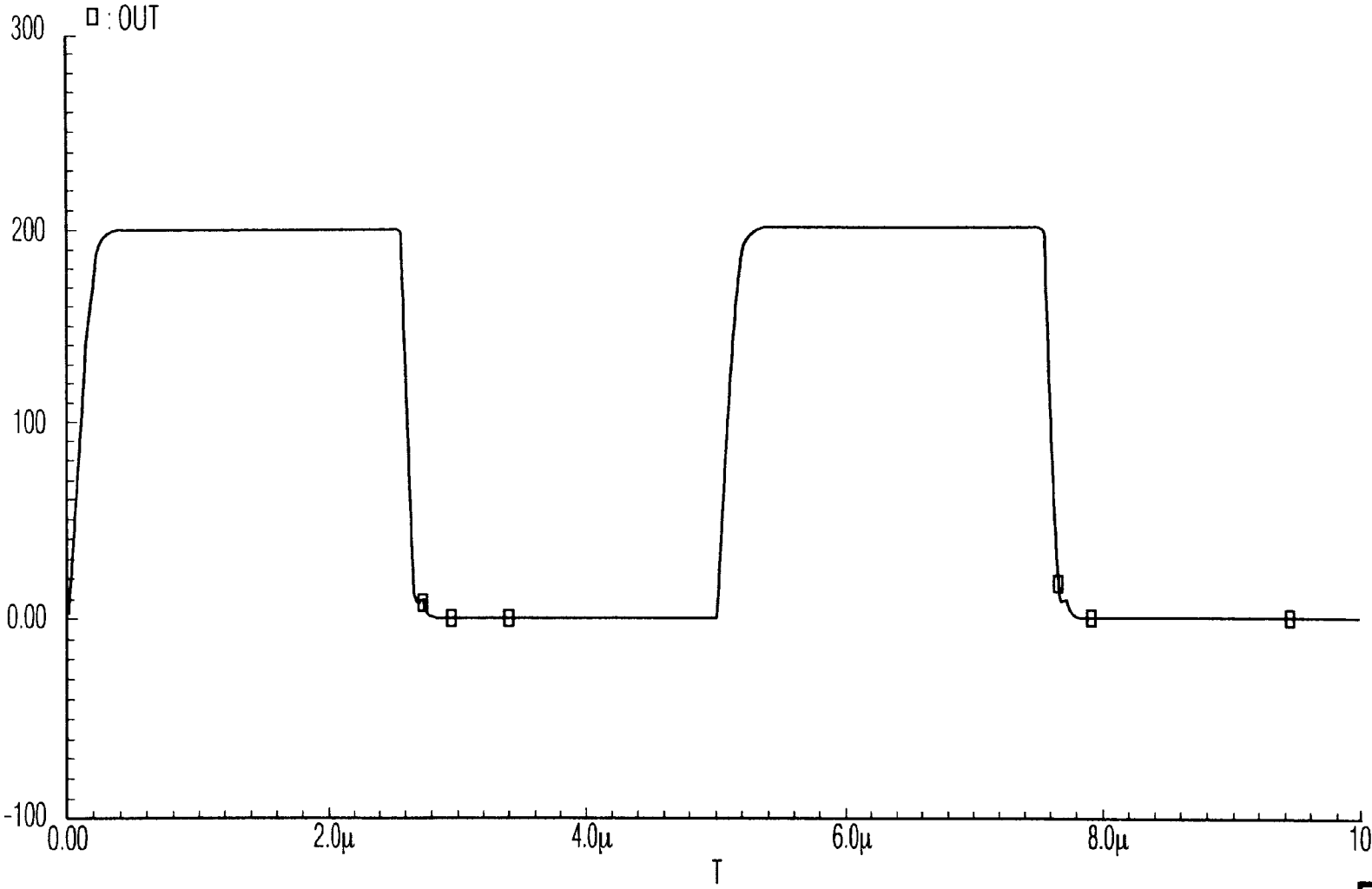
FIG. 7 illustrates a waveform diagram of the gate driver simulation results for scan output.

FIG. 7 illustrates a waveform diagram of the gate driver simulation results for scan output. The vertical axis on the waveform shows that the voltage ranges from about 0 volts to about 200 volts. The horizontal axis shows that a time period between about 0 $\mu$s and about 10 $\mu$s.

Figure 8:
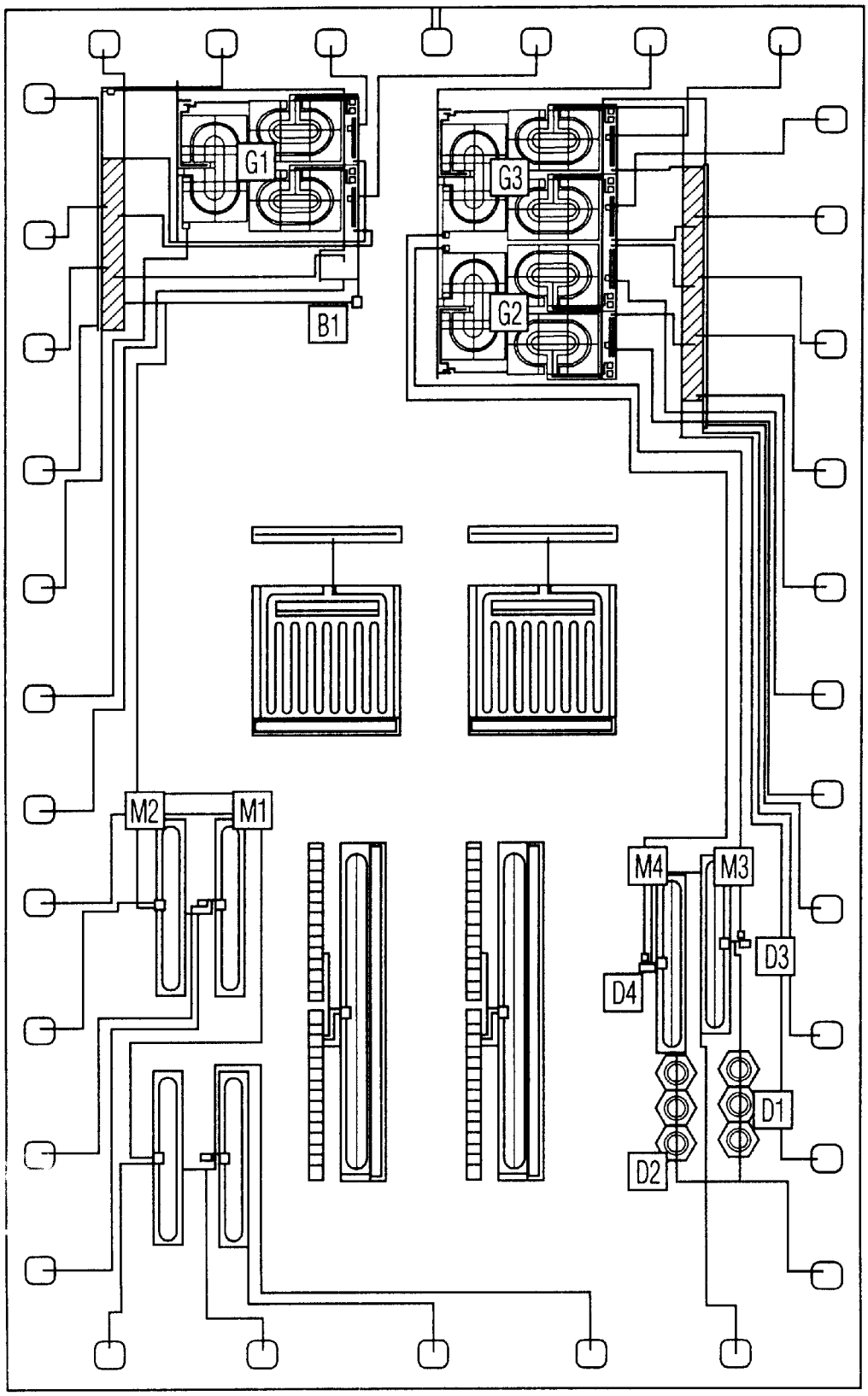
FIG. 8 illustrates the test chip layout for the scan/sustain driver.

FIG. 8 illustrates the test chip layout for the scan/sustain driver. This is a prototype of the schematic shown in FIGS.

1A and 1B. The left side of the layout shows the three gate drivers G1, G2 and G3, and the buffer B1. The top right side of the layout shows transistors M3 and M4, and diodes D1, D2, D3, D4 and D5. Two pairs of M1/M2 transistors are shown on the bottom right side to provide two versions for testing. One version has more current capability and therefore, less dissipation. The dimensions of the chip are approximately 2.9 mm×4.7 mm.

Figure 9:
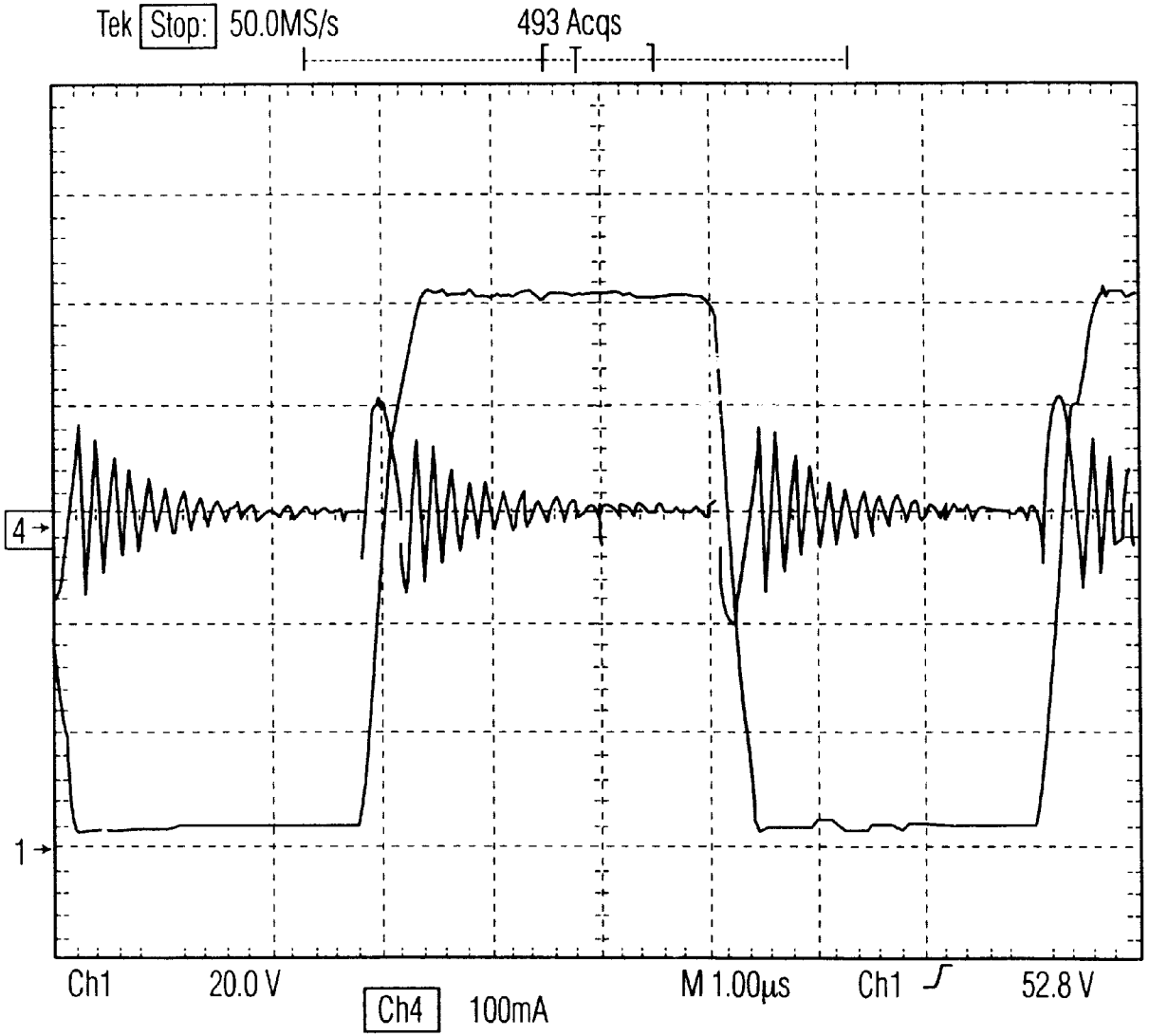
FIG. 9 shows the experimental results for the sustain function only.

FIG. 9 shows the experimental results for the sustain function only. The large trace is the voltage output and the small trace is the energy recovery current through the external inductor. There are about 20 volts per division and about 100 mA per division.

Figure 10:
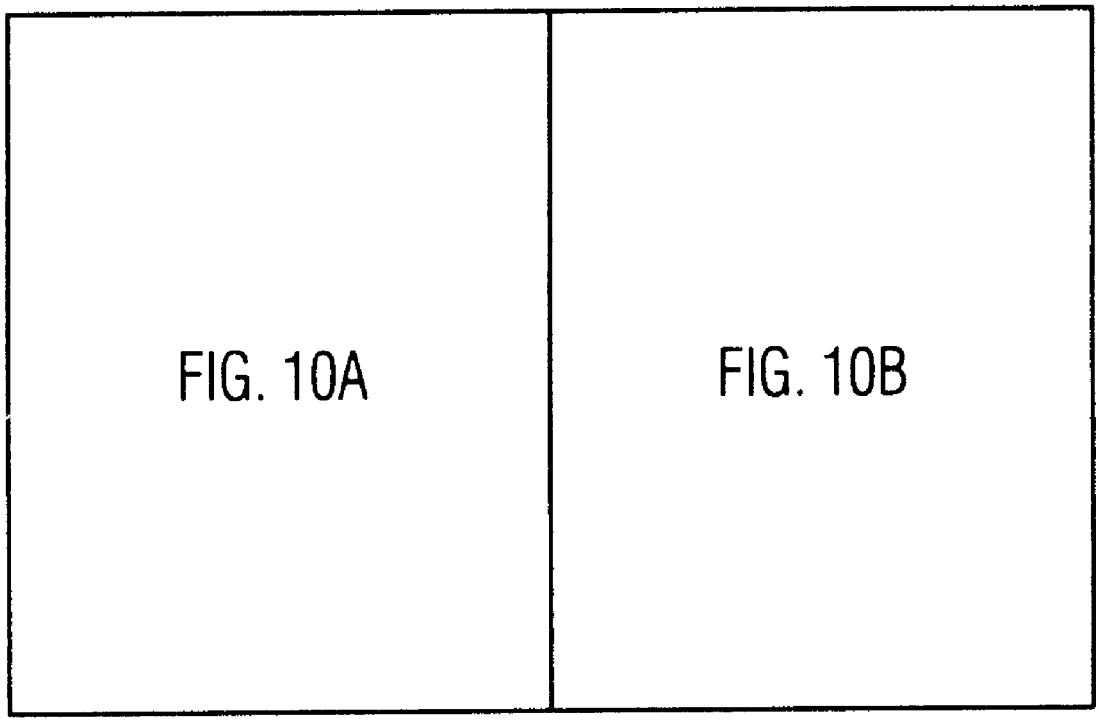
FIGS. 10, 10A, 10B represent a top and detail level schematic for the scan/sustain driver test chip.
Figure 10A:
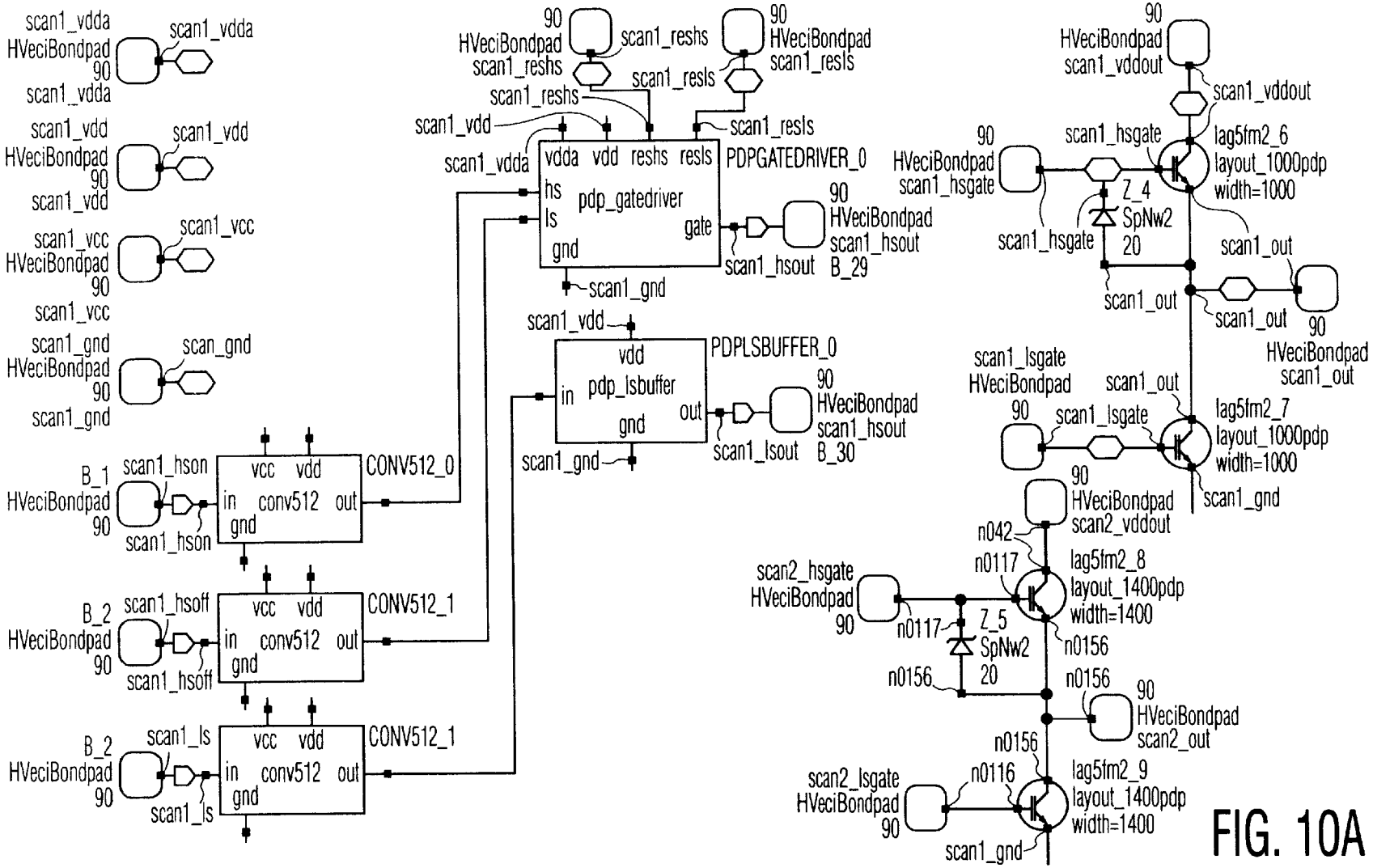
Figure 10B:
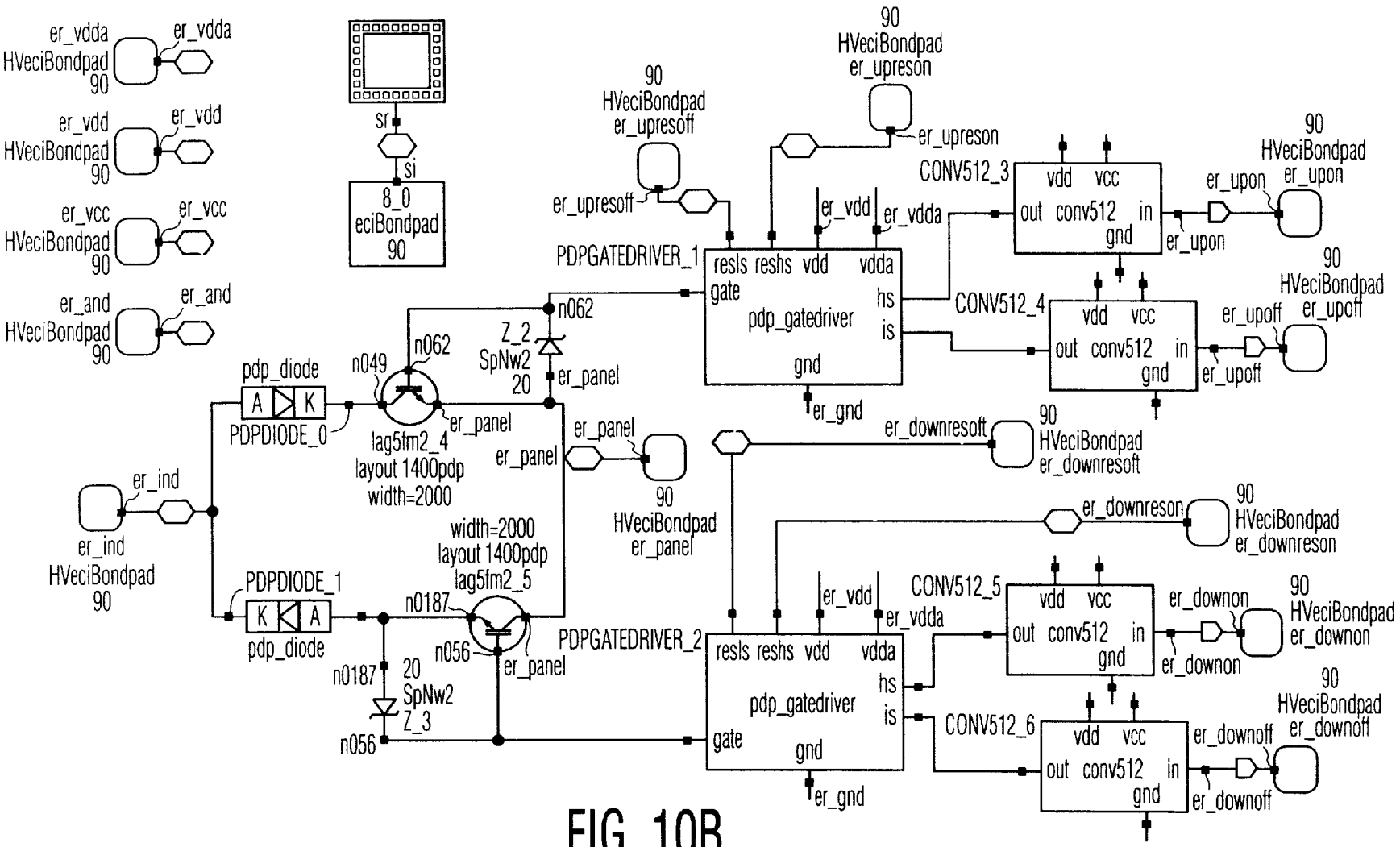

FIGS. 10, 10A, 10B represent a top and detail level schematic for the scan/sustain driver shown in FIGS. 1A and 1B. From left to right the following is shown: on the left, signals A5, A6 and A7, gate driver G1 and buffer B1, and on the right, gate drivers G1 and G2, and signals A1, A2, A3 and A4.

Figure 11:
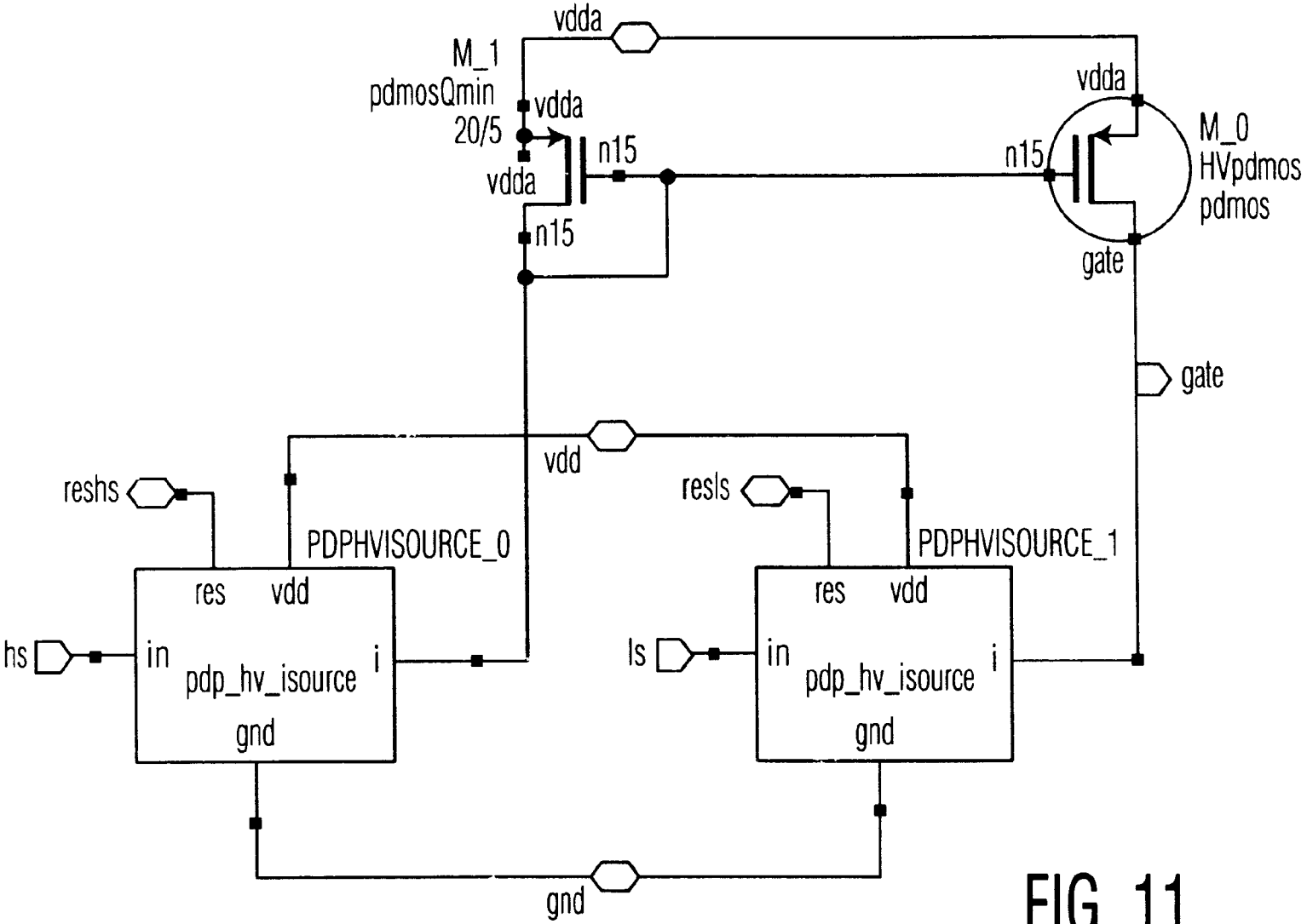
FIG. 11 represents the test chip gate driver schematic.

FIG. 11 represents the gate driver schematic. The top left transistor represents M16 and the top right transistor represents M11 from FIG. 2A. The bottom left block represents transistors M17, M18 and M20 and resistor R12 from FIG. 2A. The bottom right block represents transistors M12, M13 and M15 and resistor R11 from FIG. 2A.

Figure 12:
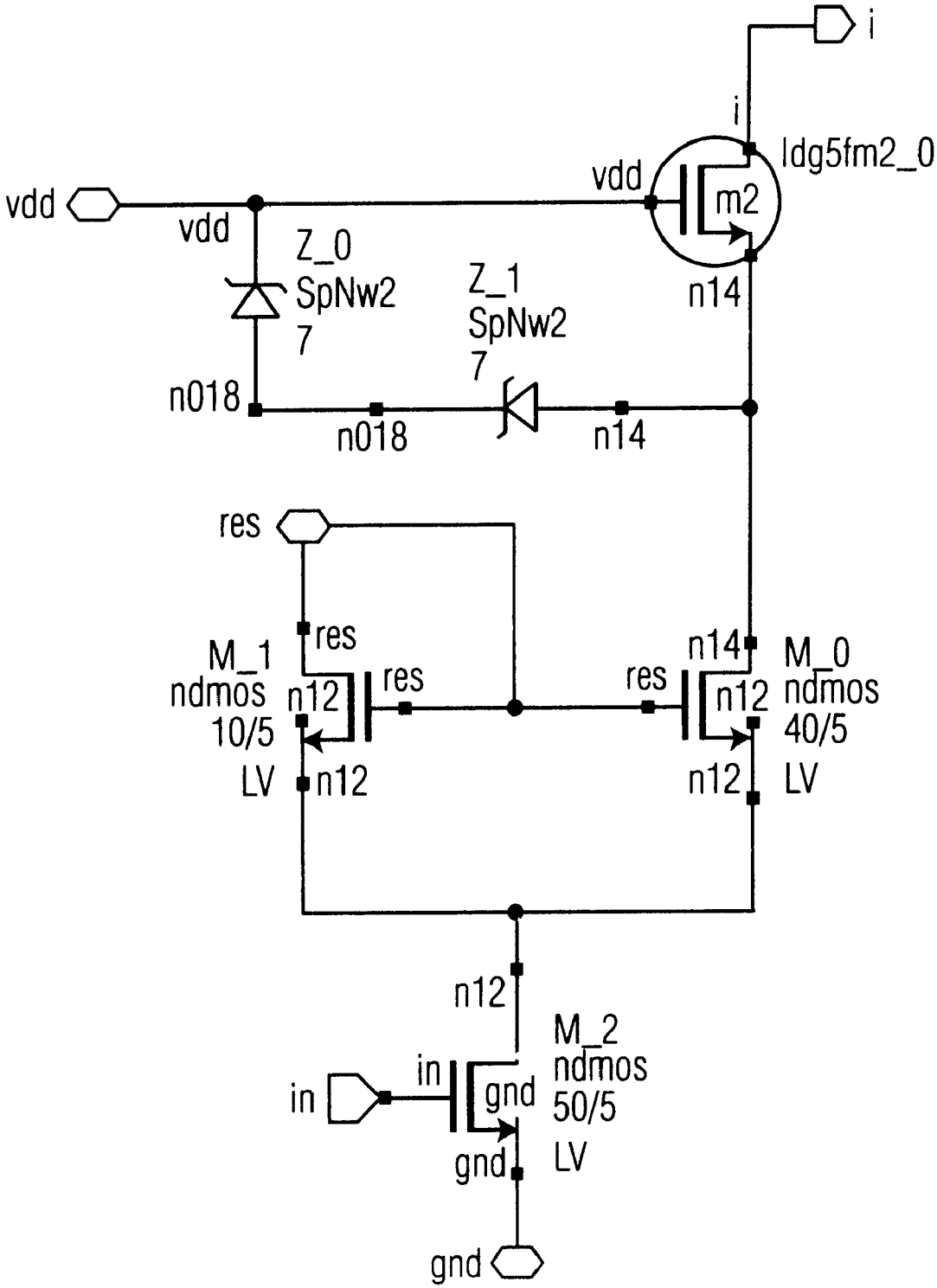
FIG. 12 schematically shows the test chip high voltage current source.

FIG. 12 schematically shows the high voltage current source. The figure shows a high voltage N-type transistor, two zener diodes, and three low voltage N-type transistors.

Figure 13:
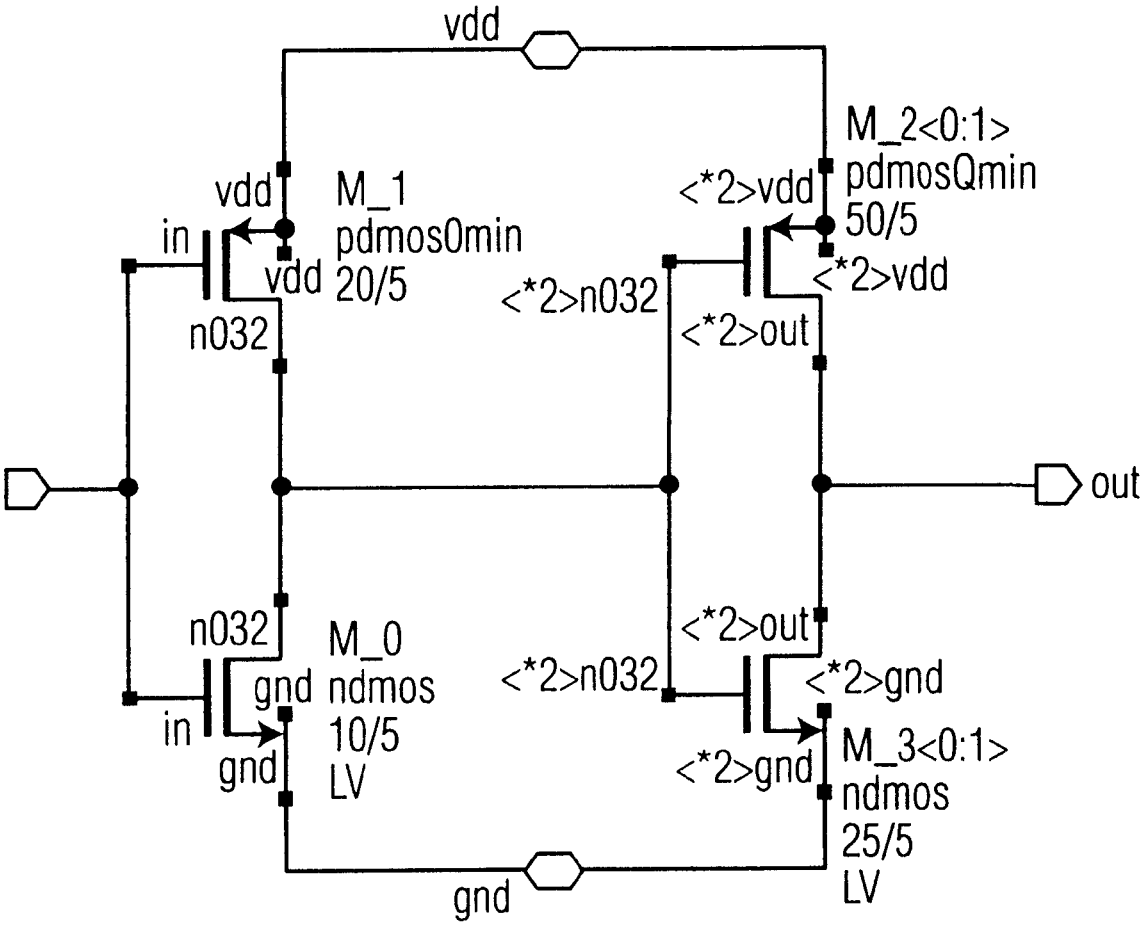
FIG. 13 schematically shows the test chip low side gate driver.

FIG. 13 schematically shows the low side gate driver. The figure shows two low voltage P-type transistors and two low voltage N-type transistors.

Figure 14:
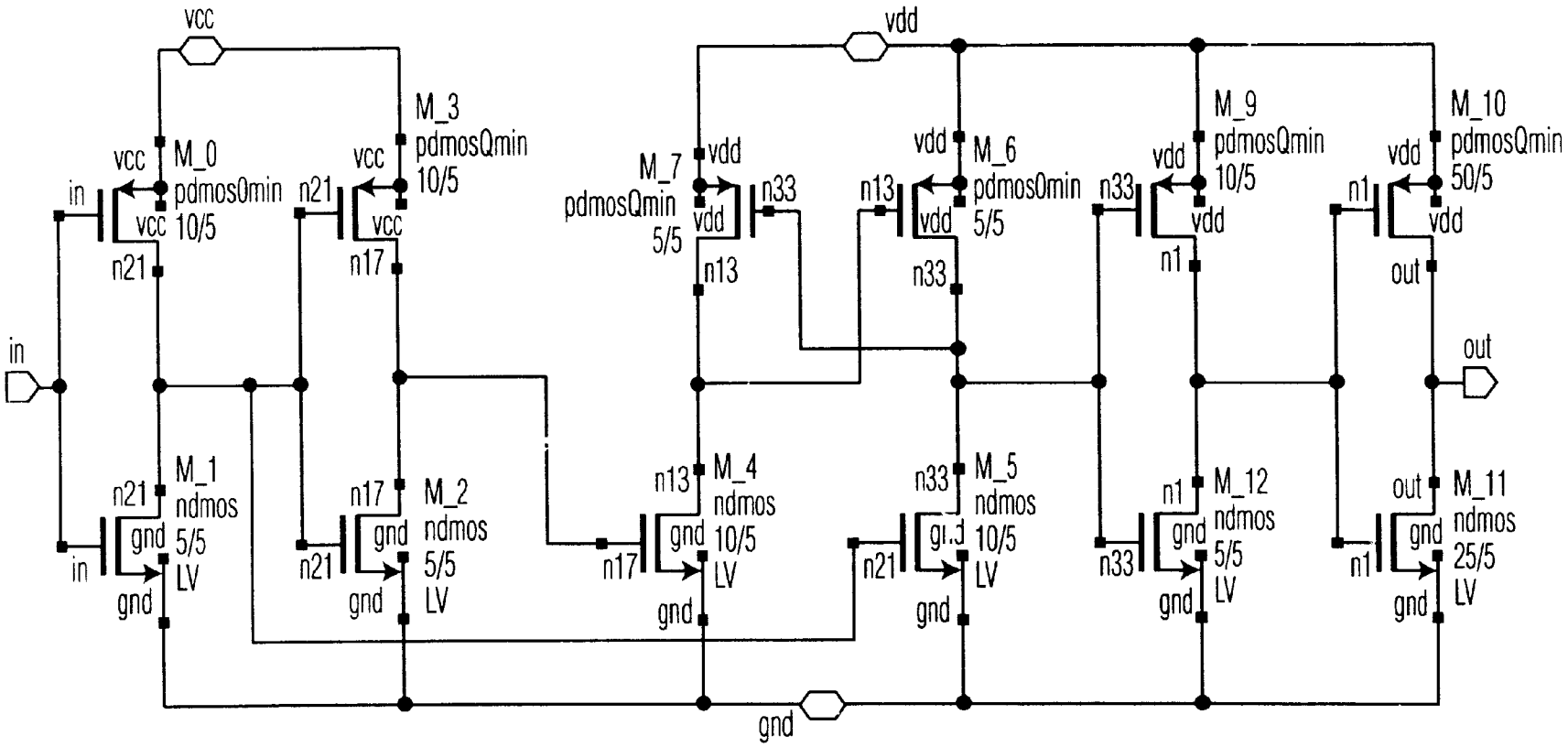
FIG. 14 schematically shows the test chip 5V to 12V converter.

FIG. 14 schematically shows the 5V to 12V converter. The figure shows six low voltage P-type transistors in the top half of the circuit and six low voltage N-type transistors in the bottom half of the circuit.

Figure 15A:
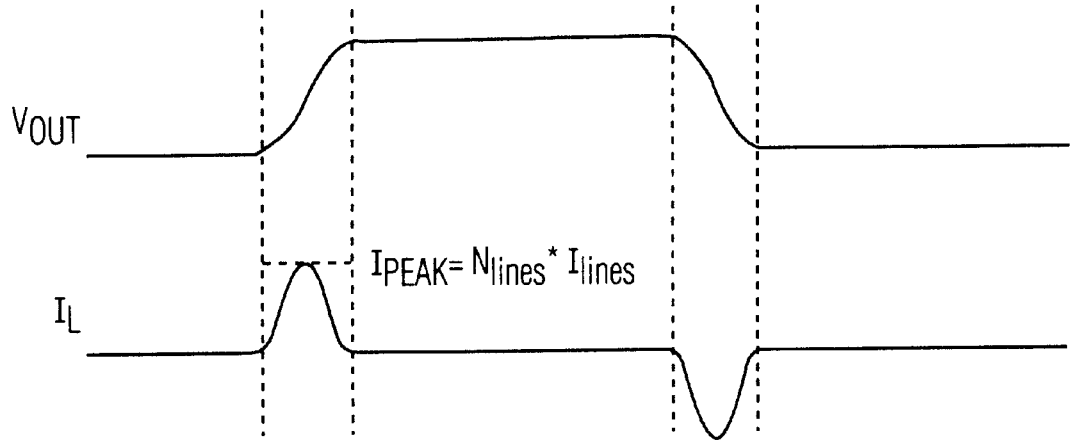
FIGS. 15A and 15B illustrate waveforms for a single-phase system and a two-phase system, respectively.
Figure 15B:
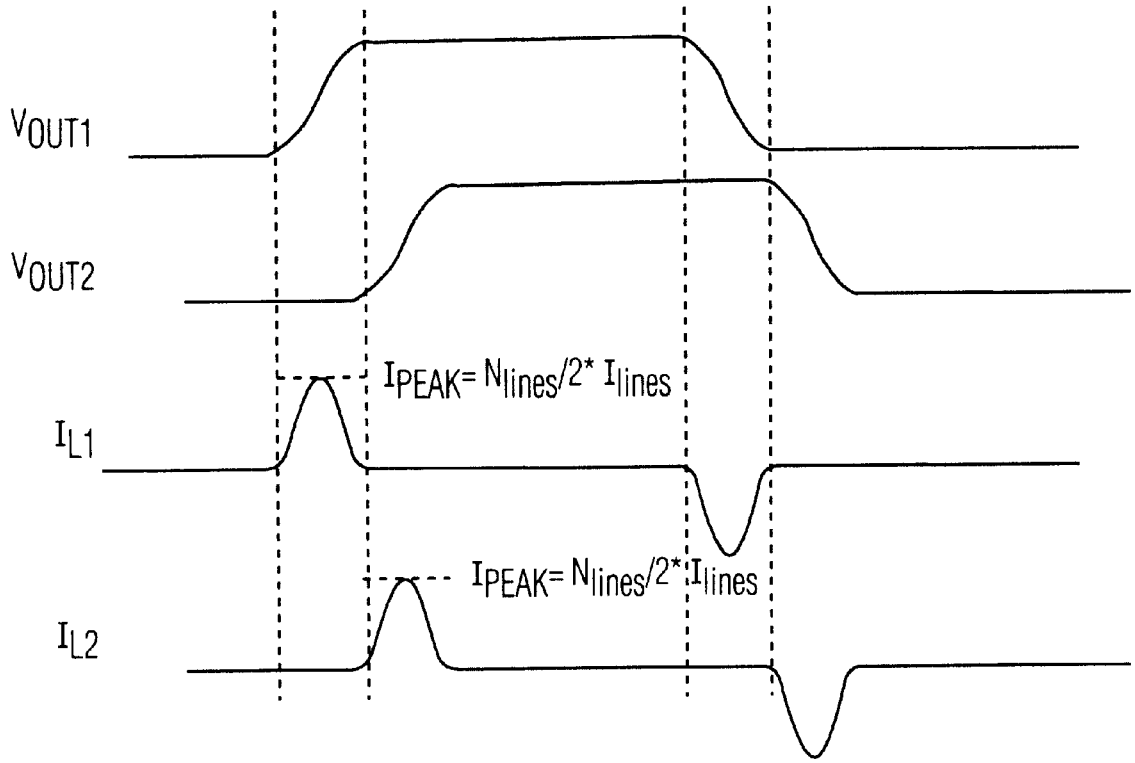

FIGS. 15A and 15B illustrate waveforms for a single-phase system and a two-phase system, respectively. The figures represent voltage to the panel and current through the inductor for a white image. The peak current that the system sees is reduced by two in FIG. 16B.

Figure 16A:
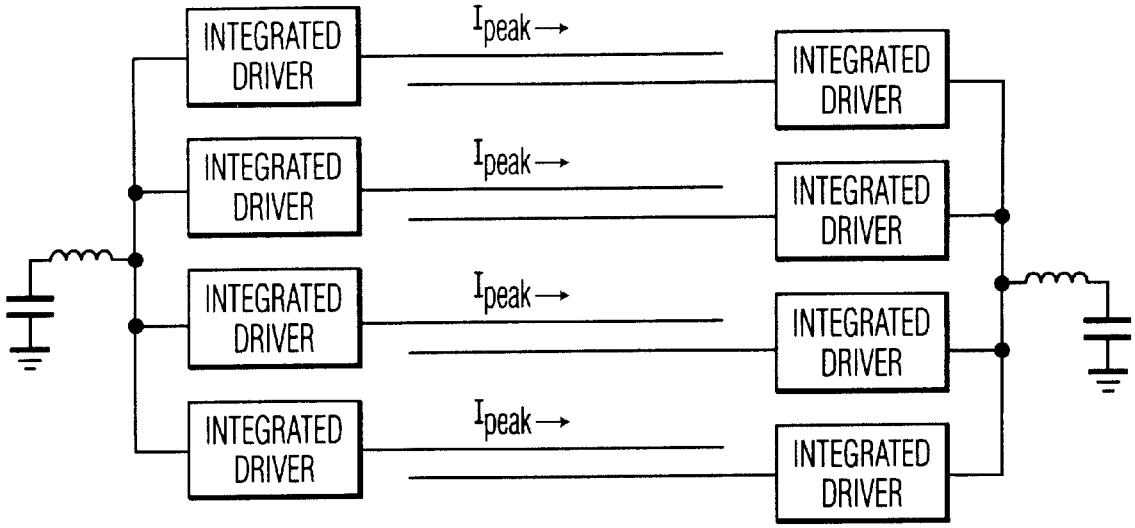
FIGS. 16A and 16B illustrate the standard recovery scheme for all currents in the same direction and currents creating canceling magnetic fields, respectively.
Figure 16B:
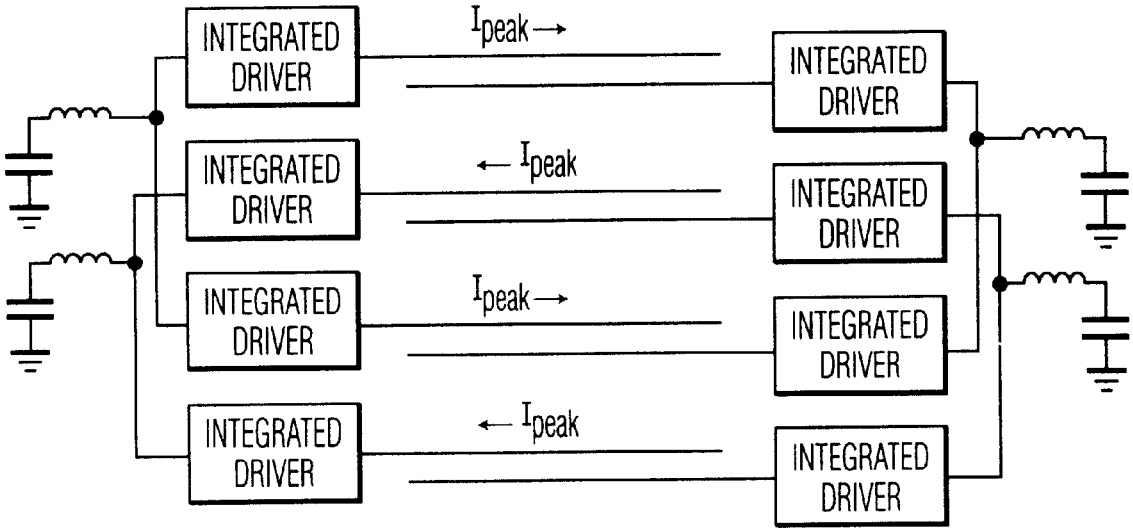

FIGS. 16A and 16B illustrate the standard recovery scheme for all currents in the same direction and currents creating canceling magnetic fields, respectively. FIG. 16A shows the standard recovery scheme with all currents in the same direction., FIG. 16B shows the cross-current configuration, where the currents create canceling magnetic fields, thereby reducing EMI. The integrated driver configuration remains unchanged; more energy recovery components are needed to increase energy recovery.

The integrated circuit of the present invention uses integrated fabrication and allows scanning as well as sustaining with the same circuit. Two transistor types have been used as drivers and switches in the circuits. The circuit uses lateral insulated-gate bipolar transistors (LIGBT) with or without NWD implant and on-chip circular diodes. The LIGBTs are used in the thyristor mode and the on-chip diodes are circular diodes. However, standard MOSFETs can be used. The transistors are smaller than those used previously. Their properties will be assessed with these circuits to evaluate their potential use in future PDP drivers.

Dynamic gate drivers that do not require external components are used to level-shift the control signals. Dynamic describes the charging of the gate and the potential remains, i.e., the gate voltage is maintained. The level shifters are externally tunable to optimize the circuit performance. The drivers can be paralleled and used to sustain multiple lines using a single inductor for energy recovery. Oscillation may be a problem, which may not have an impact on image quality, but it can be solved by dissipating more power.

Other advantages of the present invention include the following. A combined scan and sustain driver in PDPs reduces the integrated circuit silicon area (about 20%) compared to a full SOI integration. However, there is no solution yet for full SOI integration and discrete components cannot be easily compared to the integrated circuit in the present invention. There is also a reduced component count and reduced power losses through scan transistor body diodes. The present invention has better voltage load regulation because there is less resistance between the panel and the voltage supply, which increases operating margin and image quality by reducing the risks of misfires. Rows are sustained individually which reduces peak current (about 240 mA) by varying the timing of plasma discharges and reduces EMI by alternating the current direction in each row and thus, drives rows in opposite directions. The variation of the timing is comparable to time multiplexing. The variation can be accomplished by a short delay of about 100 ns to about 200 ns or by creating a difference in phase by having a different inductor for each energy recovery circuit (if the current is changed). The two phases are about 100 ns apart and current is extended in opposite directions so that they cancel each other out. This is in contrast to LCDs, which use dot inversions. A smaller EMI shield can be used in the present invention to meet U.S. regulations for emission. Each row has a dedicated sustain driver and each group of rows is connected to a different inductor. The number of phases equals the number of inductors. In contrast, the prior art sustains simultaneously all rows of the panel. Optimization of power dissipated in the gate drivers is achieved by scaling the transistor width and logic timing control to optimize performance and minimize dissipation. A 48" screen can be scaled to 60" to increase resolution in the present invention by increasing the number of integrated drivers, since one per row is required. In contrast, the discrete transistors in the prior art are not capable of scaling up the resolution on a line-by-line basis. Other options in the prior art are adding drivers to make the circuit modular.

Combining scan and sustain drivers in PDPs has future implications. Testing conditions showed about a 66% energy recovery was measured with about a 100V VDDA supply. A measurement of prior art energy recovery is not clear since discrete components are used, but an estimate is about 50–80%. The loss through the diodes and the transistors depends on the area of the driver. Other issues are a function of the device. Dynamic level shifting requires optimization for size and power. The ringing produced is inherent in drivers because of the parasitic capacitance of the metal interconnections and active devices. These values, which are considered parasitic because they are determined by the placement of the devices rather than as part of the design schematics, are used in logic or circuit simulations. Finally, the appropriateness of LIGBTs for energy recovery switches has to be established. Shorted-anode LIGBTs or MOSFETs such as DMOS transistors may be more appropriate for transistors M1, M2, M3 and M4. These transistors are smaller in size but more difficult to control.

It will be apparent to those skilled in the art that various modifications and variation can be made in the present invention without departing from the spirit or scope of the invention. Thus, it is intended that the present invention covers the modifications and variations of this invention provided they come within the scope of the appended claims and their equivalents.

What is claimed is:

1. A scan/sustain driver circuit for a plasma display panel, comprising:

a chip including:

at least three gate drivers, wherein each gate driver has at least one high selector and at least one low selector for digital logic control;

at least four high voltage first-type transistors;

at least two high voltage diodes;

at least three zener diodes;

a low voltage buffer having at least one low selector; and an energy recovery circuit provided external to the chip;

wherein at least one of the at least four high voltage first-type transistors is connected to a voltage supply of about 200 volts; and wherein at least one of the at least four high voltage first-type transistors is connected to ground.

2. The scan/sustain driver circuit of claim 1, wherein the digital control logic is provided externally or internally of the chip.

3. The scan/sustain driver circuit of claim 1, wherein the energy recovery circuit includes an inductor and a capacitor.

4. The scan/sustain driver circuit of claim 1, wherein the at least three gate drivers include:

at least one high voltage second-type transistor;

at least two high voltage first-type transistors;

at least two current mirrors comprising a plurality of low voltage first-type transistors;

a first low voltage first-type transistor connected to one of the at least two current mirrors, a high selector and to a ground;

a second low voltage first-type transistor connected to one of the at least two current mirrors, a low selector and to a ground;

a resistor connected to a low voltage supply, and in parallel with one of the at least two high voltage first-type transistors; and one of the at least two current mirrors; and a voltage supply of about 207 volts providing voltage to the at least one high voltage second-type transistor and the at least one low voltage second-type transistor.

5. The scan/sustain circuit of claim 1, wherein the buffer circuit includes:

at least two low voltage supplies;

at least two low voltage first-type transistors; and at least two low voltage second-type transistors.

6. The scan/sustain circuit of claim 1, wherein the transistors are LIGBTs.

7. The scan/sustain circuit of claim I, wherein the transistors are MOSFETs.

8. The scan/sustain circuit of claim 1, wherein the first-type transistor is N-type.

9. The scan/sustain circuit of claim 4, wherein the first-type transistor is N-type.

10. The scan/sustain circuit of claim 5, wherein the first-type transistor is N-type.

11. The scan/sustain circuit of claim 1, wherein the second-type transistor is P-type.

12. The scan/sustain circuit of claim 4, wherein the second-type transistor is P-type.

13. The scan/sustain circuit of claim 5, wherein the second-type transistor is P-type.

14. The scan/sustain circuit of claim 1, wherein the at least three zener diodes have a cathode connected to the at least three gate drivers and the at least three zener diodes are connected in parallel with three of the at least four high voltage first-type transistors.

15. The scan/sustain circuit of claim 14, wherein the low voltage buffer is connected in series with the other of the at least four high voltage first-type transistors.

* * * * *